US006149053A

United States Patent [19]

Chatterton et al.

[11] Patent Number: 6,149,053

[45] **Date of Patent: *Nov. 21, 2000**

[54] BEND-RESISTANT FOIL CONTAINER

[75] Inventors: Chadd R. Chatterton, Kenosha, Wis.; Thomas J. Hayes, Wauconda; Michael J. A. Sagan, Batavia, both of Ill.

[73] Assignee: Tenneco Packaging Inc., Evanston, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/925,559

[22] Filed: Sep. 8, 1997

[51] Int. Cl.[7] ..... B65D 1/00

[52] U.S. Cl. ..... 229/407; 229/406; 229/3.5 MF; 220/608; 220/912

[58] Field of Search ..... 220/609, 608, 220/514, 604, 669, 675, 912; 229/3.5 MF, 406; 206/557, 564; D7/550.1, 554; D9/425

[56] References Cited

U.S. PATENT DOCUMENTS

| | | | |
|---|---|---|---|
| D. 198,290 | 5/1964 | Miller, Jr. | D9/425 |
| D. 249,234 | 9/1978 | Limon et al. | D9/425 |
| D. 287,809 | 1/1987 | Alexander . | |
| D. 288,055 | 2/1987 | Alexander . | |
| D. 375,652 | 11/1996 | Hayes . | |
| 2,036,572 | 4/1936 | Frost | 229/406 |
| 3,098,597 | 7/1963 | Johnson et al. | 229/3.5 MF |
| 3,233,813 | 2/1966 | Wolford et al. | 229/3.5 MF |
| 4,167,233 | 9/1979 | Hare . | |
| 4,616,762 | 10/1986 | Alexander . | |
| 4,971,216 | 11/1990 | Fortune . | |
| 5,029,721 | 7/1991 | Timpe . | |
| 5,628,427 | 5/1997 | Hayes . | |

OTHER PUBLICATIONS

"Ekcotherm Specification", Ekco Products, Inc., 2 pages, date unknown.

"Aluminum Foil Formed Products", Penny Plate®, Inc., pp. 1–19, date unknown.

"Stock Containers", Penny Plate®, Inc., pp. 1–16, 1979.

"1988 Food Service Packaging Aluminum and Plastics Specification Catalog", Wilkinson pp. 1–42, 1988.

"Chicago Metallic Food Service Foil Containers", Chicago Metallic, 4 pages, date unknown.

Chicago Metallic catalog, Chicago Metallic, Division of C.M. Products, 28 pages, Jul., 1990.

"Bulkware Specifications Catalog", HFA Inc., pp. 1–8, date unknown.

"Reynolds Aluminum Containers, Trays & Lids", Reynolds Metals Company, pp. 1–33, 1988.

"Catalog of Food Service Products", Kaiser Packaging, pp. 1–39, 1986.

"Aluminum Foil Containers and Polystyrene Dome Covers", Revere Foil Containers, pp. 1–16, date unknown.

"Price Catalog No. 665", Impax, pp. 1–20, Jun. 1, 1965.

E–Z Foil Catalog, EZ Por® Corporation, pp. 1–42, date unknown.

Alupla brochure, Cebal–Alupla, 4 pages, approx. 1975.

(List continued on next page.)

*Primary Examiner*—Gary E. Elkins
*Assistant Examiner*—Tri M. Mai
*Attorney, Agent, or Firm*—Arnold White & Durkee

[57] ABSTRACT

A foil container formed from a single sheet of metal about orthogonal longitudinal and transverse axes, comprises a bottom panel, a continuous wall panel, and a continuous rim. The continuous wall panel encompasses the bottom panel and extends upwardly and outwardly from the bottom panel. The continuous rim encompasses an upper edge of the continuous wall panel and projects laterally outwardly therefrom. The bottom panel is constructed and arranged bend strength and aesthetic appeal of the container. In one embodiment, the bottom panel forms a network of clusters including hexagonal ribs, hexagonal embossments, and bar ribs. In another embodiment, the bottom panel forms a plurality of closely spaced, concentric elliptical ribs that occupy a substantial portion of the bottom panel.

7 Claims, 12 Drawing Sheets

OTHER PUBLICATIONS

"Glaco Packaging Products", Glaco Packaging Products, pp. 1–10, date unknown.

"Carry Out Containers, Steam Tables & Roasters", Kari–Our Company, 1 page, date unknown.

"Taste More Profits in Tart and Pie Plates", Kaiser Aluminum, 6 pages, 1985.

"Kaiser Aluminum Puts More Profit in Your Cake Sales", Kaiser Aluminum, 6 pages, 1985.

"Bigger Baking Profits Begin with Aluminum Pans", Kaiser Aluminum, 6 pages, 1985.

ANACONDA catalog, ANACONDA Aluminum Company, 10 pages, 1981.

BEND-RESISTANT FOIL CONTAINER

FIELD OF THE INVENTION

The present invention relates generally to disposable foil containers and, more particularly, relates to a disposable foil container having an improved bottom panel that provides the container with superior resistance to bending than prior art containers and, at the same time, enhances the aesthetic appeal of the container.

BACKGROUND OF THE INVENTION

Various disposable and inexpensive utensils, such as metal containers for use in steaming, heating, and/or cooking food products, have become popular because they are relatively inexpensive and eliminate the need for cleaning after the steaming, heating, and/or cooking of the food product has occurred. Such metal containers are normally formed of a light or thin gauge material such as aluminum foil. Containers made from aluminum foil have the heat transference qualities associated with the metal aluminum and, yet, because of the minimal amount of metal utilized in the structure, are inexpensive and, consequently, can be disposed of after a single use.

The convenience of having an inexpensive disposable container by utilizing thin gauge metal, e.g., aluminum foil, is achieved with the attendant factor that the container has diminished structural strength. One measure of the structural strength of the container is known as the "bend strength." The "bend strength" may be defined as the maximum weight that can be lifted by the container prior to the formation of one or more deflection points in the container. A deflection point refers to the formation of a buckle along one of the sides of the container. Thin gauge foil containers are inherently weak and are incapable of carrying heavy loads without bending. Obviously, if the gauge of the metal is increased to increase the bend strength of the container, the container cost will also increase.

To achieve added bend strength without increasing the metal gauge and, at the same time, enhance the aesthetic appeal of the container, it is customary to form ribs of varying sizes and designs in the bottom panel and sides of a container. Also, controlled wrinkles or folds are often incorporated in the sides, and the rim of the container is curled or beaded in a variety of ways to increase the overall structural strength of the container. Heretofore, these strength-enhancing features have been generally successful in producing inexpensive and aesthetically-acceptable foil containers suitable for steaming, heating, and/or cooking food products. However, additional strengthening means are still desirable, especially in the bottom panel, to enable the foil containers to better handle heavy loads and to enhance the aesthetic appeal of the containers.

SUMMARY OF THE INVENTION

Accordingly, the present invention is directed to a foil container having an improved bottom panel that provides the container with superior resistance to bending than prior art containers and, at the same time, enhances the aesthetic appeal of the container. The foil container is formed from a single sheet of metal and comprises a bottom panel, a continuous wall panel, and a continuous rim. The continuous wall panel encompasses the bottom panel and extends upwardly and outwardly from the bottom panel. The continuous rim encompasses an upper edge of the continuous wall panel and projects laterally outwardly therefrom. The foil container is formed about orthogonal longitudinal and transverse axes. If the foil container is rectangular in shape, the continuous wall panel forms a pair of opposing side walls and a pair of opposing end walls, and the longitudinal axis is generally parallel to the side walls.

In a first embodiment, the bottom panel forms a network of generally complete clusters. Each of the generally complete clusters includes a central hexagonal rib and a plurality of first hexagonal embossments substantially encompassing and bordering on the central hexagonal rib. The central hexagonal rib and the first hexagonal embossments extend upwardly from a lowermost surface of the bottom panel, and the central hexagonal rib is preferably higher than the first hexagonal embossments above the lowermost surface of the bottom panel.

The plurality of generally complete clusters preferably includes at least four generally complete clusters. Two of these four generally complete clusters are symmetrically disposed about opposite sides of the transverse axis along the longitudinal axis. The remaining two of these four generally complete clusters are symmetrically disposed about opposite sides of the longitudinal axis along the transverse axis. To optimize the bend resistance of the bottom panel, especially in the transverse direction, the central hexagonal rib of each cluster is preferably oriented with two of its six sides perpendicular to the transverse axis. Likewise, the first hexagonal embossments each have two of their six sides perpendicular the transverse axis.

In addition to the generally complete clusters, the bottom panel preferably forms a pluality of partial clusters. Each of the partial clusters couples adjacent ones of the generally complete clusters and includes a plurality of second hexagonal embossments. At least one of the second hexagonal embossments of each partial cluster is joined to at least one of the first hexagonal embossments of a respective adjacent one of the generally complete clusters by a respective bar rib. To optimize the bend resistance of the bottom panel, especially in the transverse direction, the bar rib is preferably oriented perpendicular the transverse axis.

The use of hexagonal elements for forming the generally complete and partial clusters described above is advantageous because the hexagonal shape of the elements is stronger than many other shapes, allows the hexagonal elements to be nested or clustered in close proximity to each other, creates tortuous paths in the bottom panel which resist the transmission of bends through the bottom panel, and is aesthetically pleasing.

In a second embodiment, the foil container is preferably rectangular in shape, and the bottom panel forms a plurality of closely spaced, concentric elliptical ribs. The elliptical ribs occupy a substantial portion of the bottom panel, and the centers of the elliptical ribs coincide with a center of the bottom panel. An outermost one of these elliptical ribs is located in close proximity to the pair of opposing side walls, while an innermost one of the elliptical ribs is located in close proximity to the center of the bottom panel. When arranged as described above, the elliptical ribs effectively disperse torsional and bending stresses applied to the container and thereby optimize the bend resistance of the bottom wall. At the same time, the elliptical ribs enhance the aesthetic appeal of the container.

BRIEF DESCRIPTION OF THE DRAWINGS

Other objects and advantages of the invention will become apparent upon reading the following detailed description and upon reference to the drawings in which.

Figure 1:
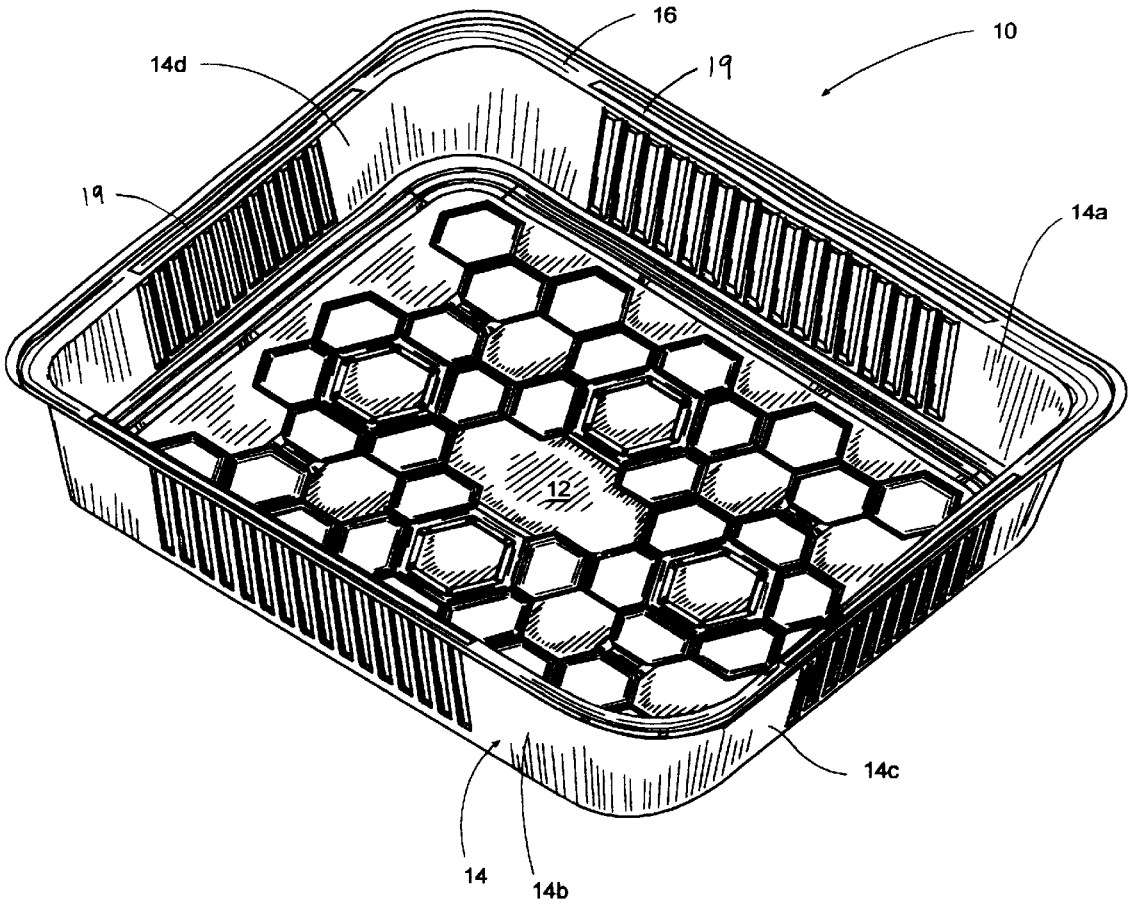
FIG. 1 is an isometric view of a disposable foil container in accordance with a first embodiment of the present invention.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF ILLUSTRATIVE EMBODIMENTS

Figure 2:
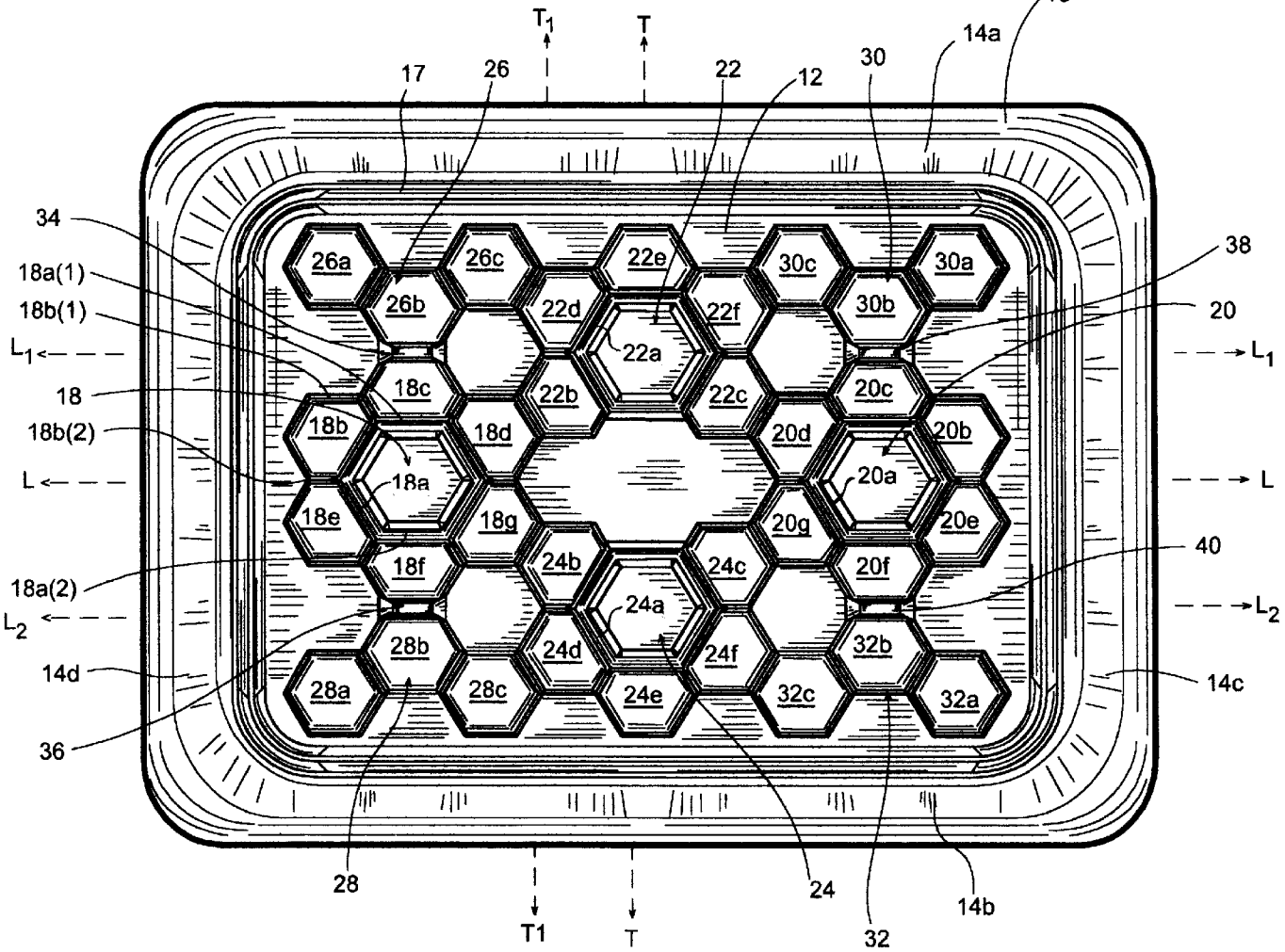
FIG. 2 is a top view of the foil container of FIG. 1.

Turning now to the drawings, FIGS. 1 and 2 depict a disposable foil container 10 in accordance with a first embodiment of the present invention. The container 10 is formed about orthogonal longitudinal and transverse axes. The longitudinal axis is labeled L in FIG. 2, while the transverse axis is labeled T in FIG. 2.

The foil container 10 is formed from a single sheet of thin gauge metal such as aluminum foil. If the selected metal is aluminum foil, the gauge or thickness is preferably in the range from approximately 0.0030 inches to approximately 0.0075 inches. The aluminum may either be dead soft or hardened aluminum. One preferred hardened aluminum has a hardness rating of H23 on the ASTM scale.

The container 10 includes a bottom panel 12, a continuous wall panel 14, and a continuous rim 16. The continuous wall panel 14 encompasses the bottom panel 12 and extends upwardly and outwardly from the bottom panel 12. The continuous rim 16 encompasses an upper edge of the continuous wall panel 14 and projects laterally outwardly therefrom. The rim 16 optionally includes stiffening grooves or beads 19 to enhance the stability of the rim 16. The continuous wall panel 14 forms a pair of opposing side walls 14*a* and 14*b* and a pair of opposing end walls 14*c* and 14*d*. The end walls 14*c* and 14*d* extend between the side walls 14*a* and 14*b*.

Referring to FIG. 2, the bottom panel 12 includes various features for enhancing both the bend strength and aesthetic appeal of the container 10. One conventional strength-enhancing feature is a peripheral rib 17 disposed adjacent to a lowermost edge of the continuous wall panel 14. The peripheral rib 17 helps the bottom panel 12 resist torsional and bending stresses along its periphery.

Further, the bottom panel 12 forms a network of generally complete clusters 18, 20, 22 , and 24. There are four generally complete clusters in the illustrated network, but the number of clusters may be varied depending upon the shape and size of the container 10 . Each of the generally complete clusters includes a central hexagonal rib and a plurality of hexagonal embossments substantially encompassing and bordering on the central hexagonal rib. Specifically, the cluster 18 includes a central hexagonal rib 18*a* and six hexagonal embossments 18*b–g* completely surrounding the rib 18*a*; the cluster 20 includes a central hexagonal rib 20*a* and six hexagonal embossments 20*b–g* completely surrounding the rib 20*a*; the cluster 22 includes a central hexagonal rib 22*a* and five hexagonal embossments 22*b–f* substantially surrounding the rib 22*a*; and the cluster 24 includes a central hexagonal rib 24*a* and five hexagonal embossments 24*b–f* substantially surrounding the rib 24*a*. The clusters 22 and 24 each include only five embossments, instead of six embossments, to provide a sufficiently sized flat region in the center of the bottom panel 12 for placing instructions, warnings, logos, and the like.

The clusters 18 and 20 are symmetrically disposed relative to each other about opposite sides of the transverse axis T along the longitudinal axis L. The clusters 18 and 20 are, in turn, each symmetrical about the longitudinal axis L. The clusters 22 and 24 are symmetrically disposed relative to each other about opposite sides of the longitudinal axis L along the transverse axis T. The clusters 22 and 24 are, in turn, each symmetrical about the transverse axis T.

To optimize the bend resistance of the bottom panel 12, especially in the transverse direction, the central hexagonal rib of each cluster is preferably oriented with two of its six sides perpendicular to the transverse axis T. Likewise, the hexagonal embossments each have two of their six sides perpendicular to the transverse axis T. For example, as viewed in FIG. 2, the sides 18*a*(1) and 18*a*(2) of the hexagonal rib 18 and the sides 18*b*(1) and 18*b*(2) of the hexagonal embossment 18*b* are perpendicular to the transverse axis T (and therefore parallel to the longitudinal axis L).

Although the clusters help the bottom panel 12 to resist all torsional and bending stresses which the container undergoes during shipping and handling, the clusters are particularly suited to enhancing the bend resistance of the bottom panel 12 in the transverse direction where such stresses are usually the highest. To lift the container 10, a user typically grasps the container 10 along the end walls 14*c* and 14*d* and portions of the continuous rim 16 above these end walls. Therefore, bending stresses applied to the bottom panel 12 are higher along directions parallel to the end walls 14*c* and 14*d*, i.e., along the transverse axis T and axes parallel to the transverse axis T. The orientations of the hexagonal ribs and the hexagonal embossments allow these elements to optimally resist these higher bending stresses.

In addition to the generally complete clusters 18, 20, 22, and 24, the bottom panel 12 preferably forms a plurality of partial clusters 26, 28, 30, and 32. There are four such partial clusters disposed adjacent to the respective four corners of the foil container 10. Each of the partial clusters couples adjacent ones of the generally complete clusters and includes a plurality of hexagonal embossments. Specifically, the partial cluster 26 couples the adjacent generally complete clusters 18 and 22 and includes three hexagonal embossments 26*a–c*; the partial cluster 28 couples the adjacent generally complete clusters 18 and 24 and includes three hexagonal embossments 28*a–c*; the partial cluster 30 couples the adjacent generally complete clusters 20 and 22 and includes three hexagonal embossments 30*a–c*; and the partial cluster 32 couples the adjacent generally complete clusters 20 and 24 and includes three hexagonal embossments 32*a–c*.

At least one of the hexagonal embossments of each partial cluster is joined to at least one of the hexagonal embossments of a respective adjacent one of the generally complete clusters by a respective bar rib. Specifically, the hexagonal embossment 26*b* of the partial cluster 26 is joined to the hexagonal embossment 18*c* of the generally complete cluster 18 by a bar rib 34; the hexagonal embossment 28*b* of the partial cluster is joined to the hexagonal embossment 18*f* of the generally complete cluster 18 by a bar rib 36; the hexagonal embossment 30*b* of the partial cluster 30 is joined to the hexagonal embossment 20*c* of the generally complete cluster 20 by a bar rib 38; and the hexagonal embossment 32*b* of the partial cluster 32 is joined to the hexagonal embossment 20*f* of the generally complete cluster 20 by a bar rib 40. To optimize the bend resistance of the bottom panel 12, especially in the transverse direction, the bar ribs are preferably oriented perpendicular to the transverse axis T. Moreover, the bar ribs resist stresses applied to the bottom panel 12 along off-center axes $L_1$ and $L_2$ parallel to the longitudinal axis L.

The number and arrangement of the generally complete and partial clusters is selected to resist bending of the bottom panel 12, especially in the transverse direction, and, at the same time, enhance the aesthetic appeal of the container 10. With respect to the number of clusters, the clusters occupy a substantial portion of the bottom panel 12. The hexagonal shape of the elements forming the clusters allows the hexagonal elements to be nested and clustered in close proximity to each other. With respect to the arrangement of clusters, the hexagonal elements and bar ribs are arranged to minimize lines of weakness through the bottom panel 12 in any direction and create tortuous paths which resist the transmission of bends through the bottom panel 12. For example, the tortuous path winding between the hexagonal embossments 26*c* and 22*d*, 18*d* and 22*b*, 18*a* and 24*b*, and 28*c* and 24*d* resists the transmission of bends resulting from stresses along the off-center axis $T_1$, parallel to the transverse axis T. Similar tortuous paths are created by the hexagonal elements throughout the bottom panel 12.

Figure 3:
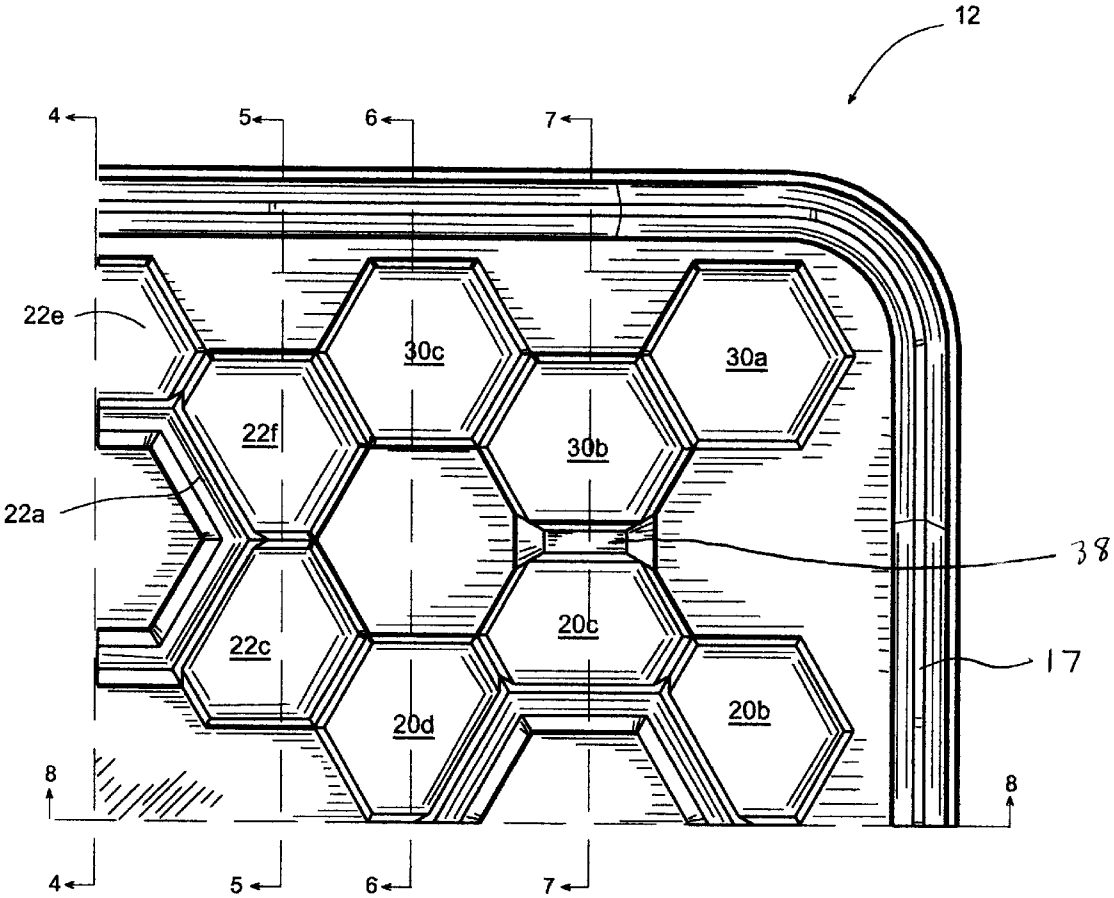
FIG. 3 is an enlarged top view of one-fourth of the bottom panel of the foil container of FIG. 1.
Figure 4:
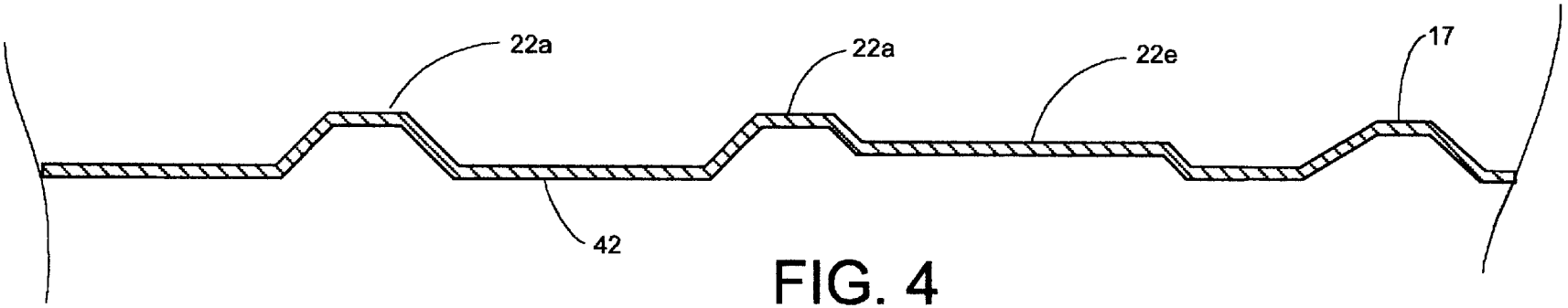
FIG. 4 is a section taken generally along line 4—4 in FIG. 3.
Figure 5:
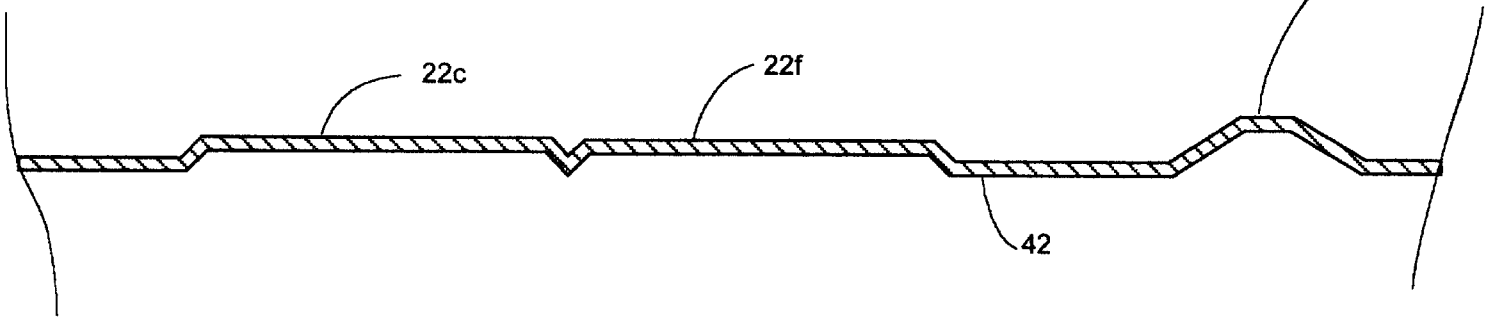
FIG. 5 is a section taken generally along line 5—5 in FIG. 3.
Figure 6:
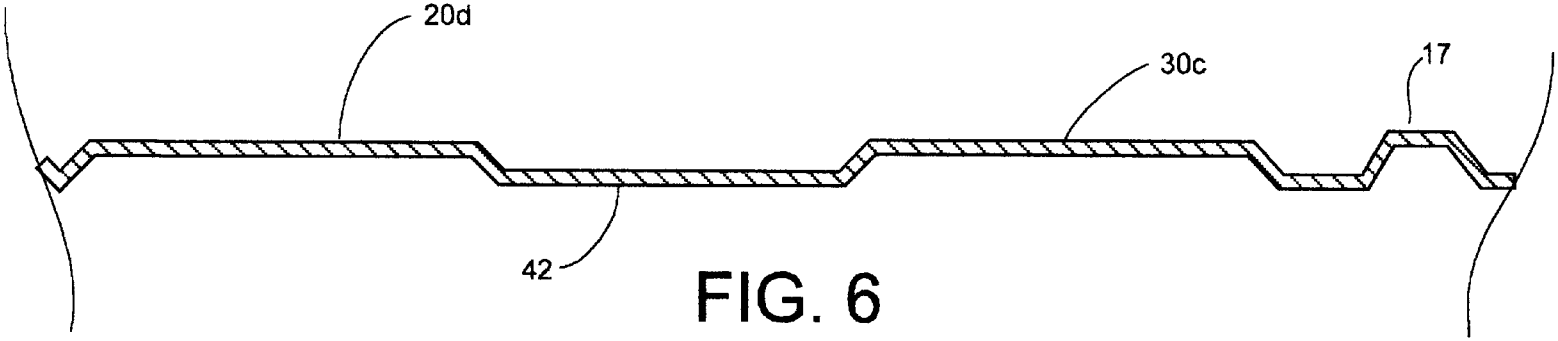
FIG. 6 is a section taken generally along line 6—6 in FIG. 3.
Figure 7:
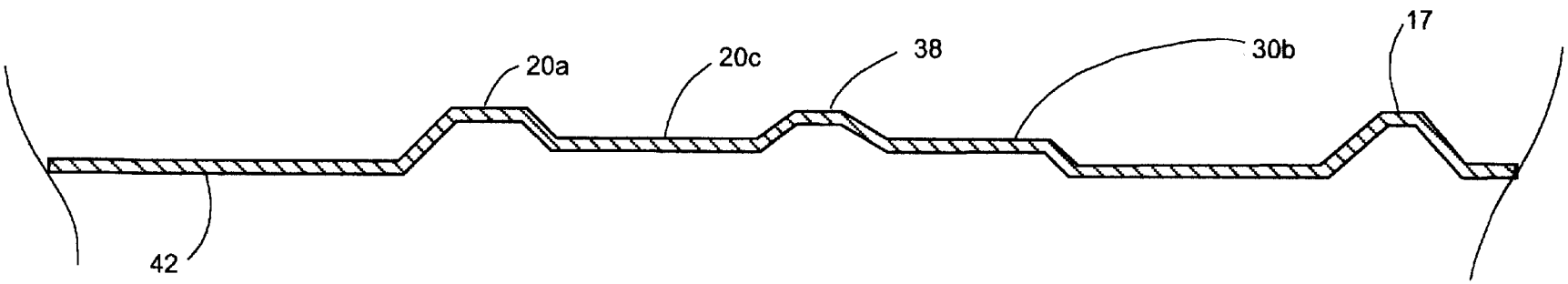
FIG. 7 is a section taken generally along line 7—7 in FIG. 3.
Figure 8:
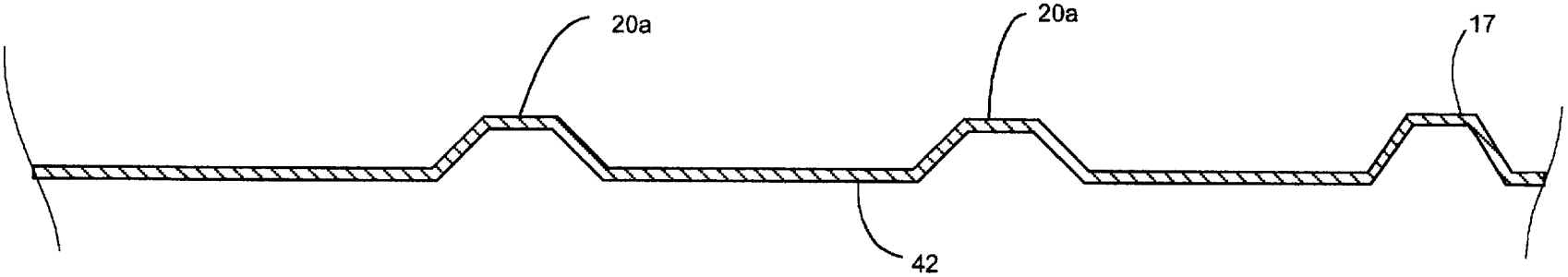
FIG. 8 is a section taken generally along line 8—8 in FIG. 3.

FIG. 3 is an enlarged top view of one-fourth of the bottom panel 12 of the foil container 10, and FIGS. 4–8 are sections taken along various lines in FIG. 3. The sections allow the cross-sectional shapes and relative heights of the hexagonal ribs, hexagonal embossments, bar ribs, and lowermost surface 42 of the bottom 12 to be more readily visualized. In FIG. 4, for example, it can be seen that the central hexagonal rib 22*a* is generally trapezoidal in cross-section, i.e. it has angled sides and a flat horizontal top bridging these angled sides. Likewise, as seen in FIG. 5, the hexagonal embossments 22*c* and 22*f* each are generally trapezoidal in cross-section. Referring back to FIG. 4, the central hexagonal rib 22*a* and the hexagonal embossment 22*e* extend upwardly from a lowermost surface 42 of the bottom panel 12, and the central hexagonal rib 22*a* is taller than the hexagonal embossment 22*e*. In a preferred embodiment, the central hexagonal rib 22*a* is twice as tall as the hexagonal embossment 22*e*. The other hexagonal ribs and embossments are formed in similar fashion.

To facilitate manufacture of the bottom panel 12, the hexagonal embossments merger into any adjacent hexagonal or bar ribs. In FIG. 4, for example, the hexagonal embossment 22*e* merges into the hexagonal rib 22*a*. In other words, the lowermost surface 42 of the bottom panel 12 does not exist between hexagonal embossment 22*e* and the hexagonal rib 22*a*. Likewise, in FIG. 7, the hexagonal embossments 20*c* and 30*b* merge into the bar rib 38, and the hexagonal embossment 20*c* also merges into the hexagonal rib 20*a*. As stated above, the foil container 10 is formed from a single metal sheet. To provide the bottom panel 12 with its various ribs and embossments, the metal sheet is passed between opposing engraved male and female forms configured to create the ribs and embossments. The forms are brought together with the metal sheet disposed therebetween to effectively stamp the ribs and embossments into the bottom panel 12. One reason for merging the embossments directly into the ribs is to prevent the metal sheet from tearing due to stresses placed on the metal sheet during the stamping process.

Figure 9:
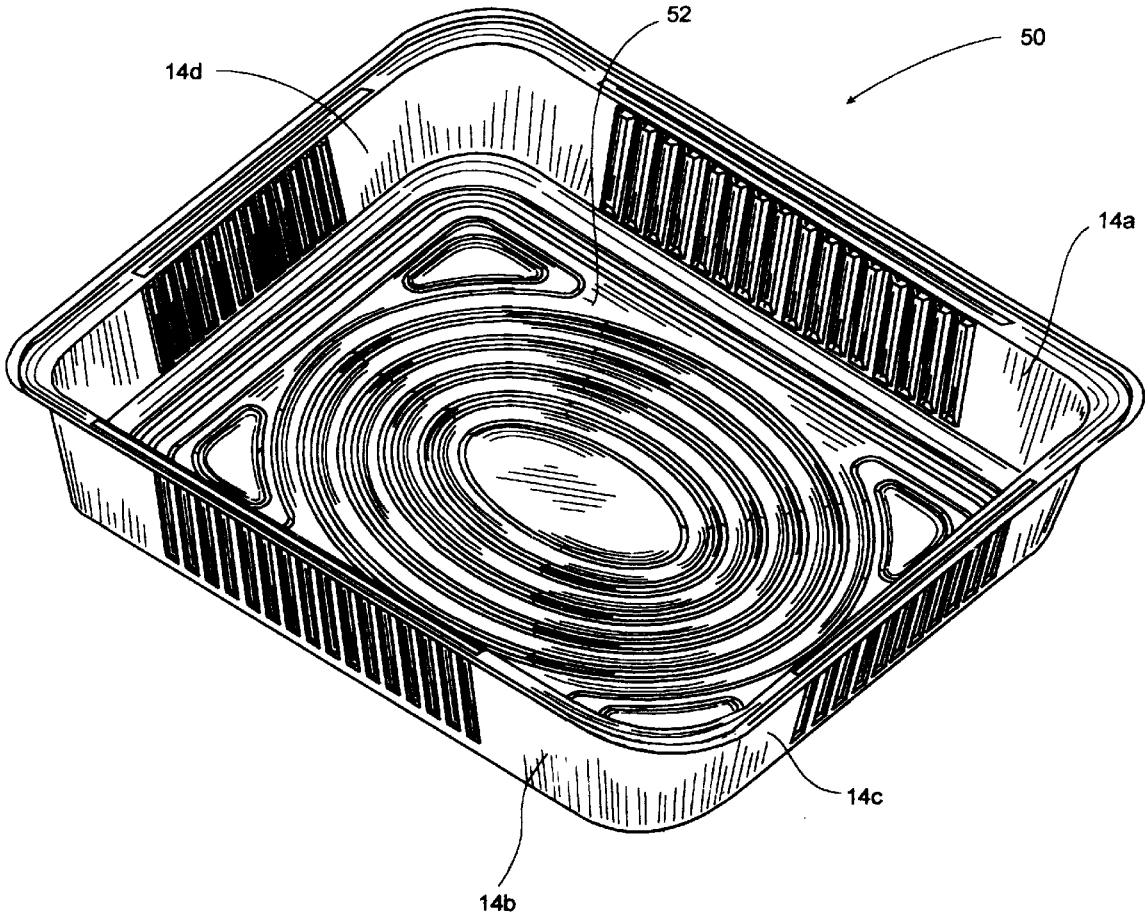
FIG. 9 is an isometric view of a disposable foil container in accordance with a second embodiment of the present invention.
Figure 10:
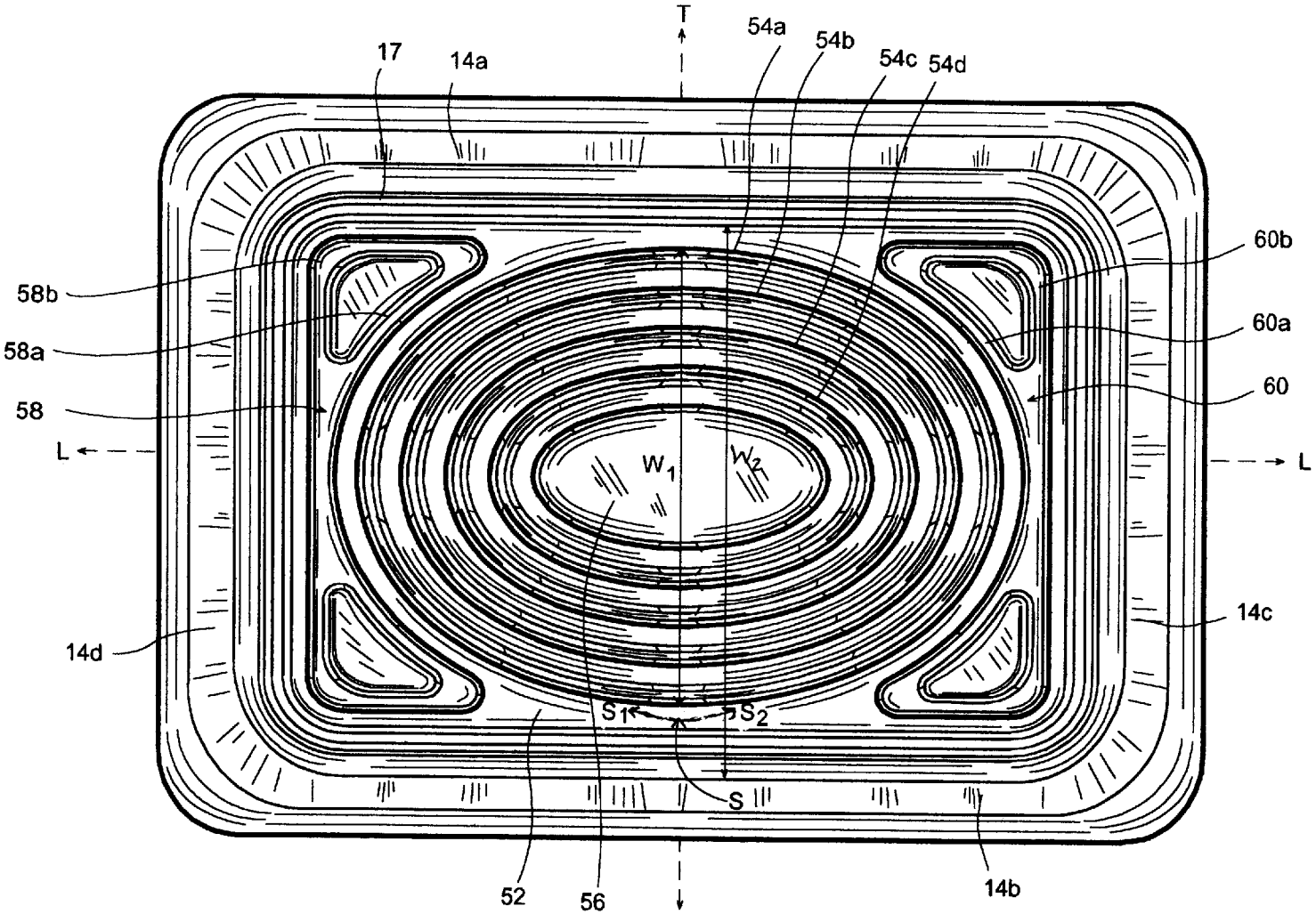
FIG. 10 is a top view of the foil container of FIG. 9.

FIGS. 9 and 10 depict a disposable foil container 50 in accordance with a second embodiment of the present invention. In FIGS. 9 and 10, as well as the remaining figures, like reference numerals are used to designate like parts. The container 50 is formed about orthogonal longitudinal and transverse axes. The longitudinal axis is labeled L in FIG. 10, while the transverse axis is labeled T in FIG. 10. Except for the construction of its bottom panel 52, the container 50 is identical to the container 10 in FIGS. 1 and 2.

The bottom panel 52 forms a plurality of closely and equally spaced, concentric elliptical ribs 54*a–d*. The elliptical ribs 54*a–d* occupy a substantial portion of the bottom panel 52, and the centers of the elliptical ribs 54*a–d* coincide with a center of the bottom panel 52. An outermost one 54*a* of these elliptical ribs is located in close proximity to the pair of opposing side walls 14*a* and 14*b*, while an innermost one 54*d* of the elliptical ribs is located in close proximity to the center of the bottom panel 52. In the preferred embodiment, the ratio of (1) the width $W_1$ of the outer rib 54*a* along the transverse axis T to (2) the width $W_2$ of the bottom panel 52 is preferably greater than or equal to approximately 65 percent (e.g., $W_1/W_2 \geqq 65\%$). The ratio of (1) the area $A_1$ of the outer rib 54*a* and the elliptical portion of the bottom panel 52 encompassed by the outer rib 54*a* to (2) the area $A_2$ of the entire bottom panel 52 is preferably greater than or equal to approximately 28 percent (e.g., $A_1/A_2 \geqq 28\%$) and is most preferably about 42 percent (e.g., $A_1/A_2 \approx 42\%$). Also, the shortest distance between the peaks of adjacent ribs is preferably 0.5 inch, but may be varied depending upon the needs of the particular application involved. Therefore, as an example, the distance between the peak of rib 54*a* and the peak of rib 54*b* is 0.5 inch.

In addition to the elliptical ribs 54*a–d*, the bottom panel 52 forms a central elliptical embossment 56, a peripheral rib 17, and outer rib structures 58 and 60. The foregoing elements enhance the bend resistance and aesthetic appeal of the bottom panel 52. The center of the elliptical embossment 56 coincides with the center of the bottom panel 52. The elevated surface of the elliptical embossment 56 provides a convenient region for embossing instructions, logos, and the like. The outer rib structures 58 and 60 strengthen the bottom panel 52 at its four corners in areas unoccupied by the elliptical ribs 54*a–d* and the peripheral rib 17. To strengthen the bottom panel 52 at these corners, each outer rib structure essentially combines the shapes of the elliptical ribs 54*a–d* and the peripheral rib 17 to fill the corner regions. Specifically, the outer rib structure 58 is a combination of a partial elliptical rib 58*a* and a partial peripheral rib 58*b*, while the outer rib structure 60 is the combination of a partial elliptical rib 60*a* and a partial peripheral rib 60*b*. The partial elliptical ribs 58*a* and 60*a* have the same curvature as the elliptical ribs 54*a–d*.

Figure 11:
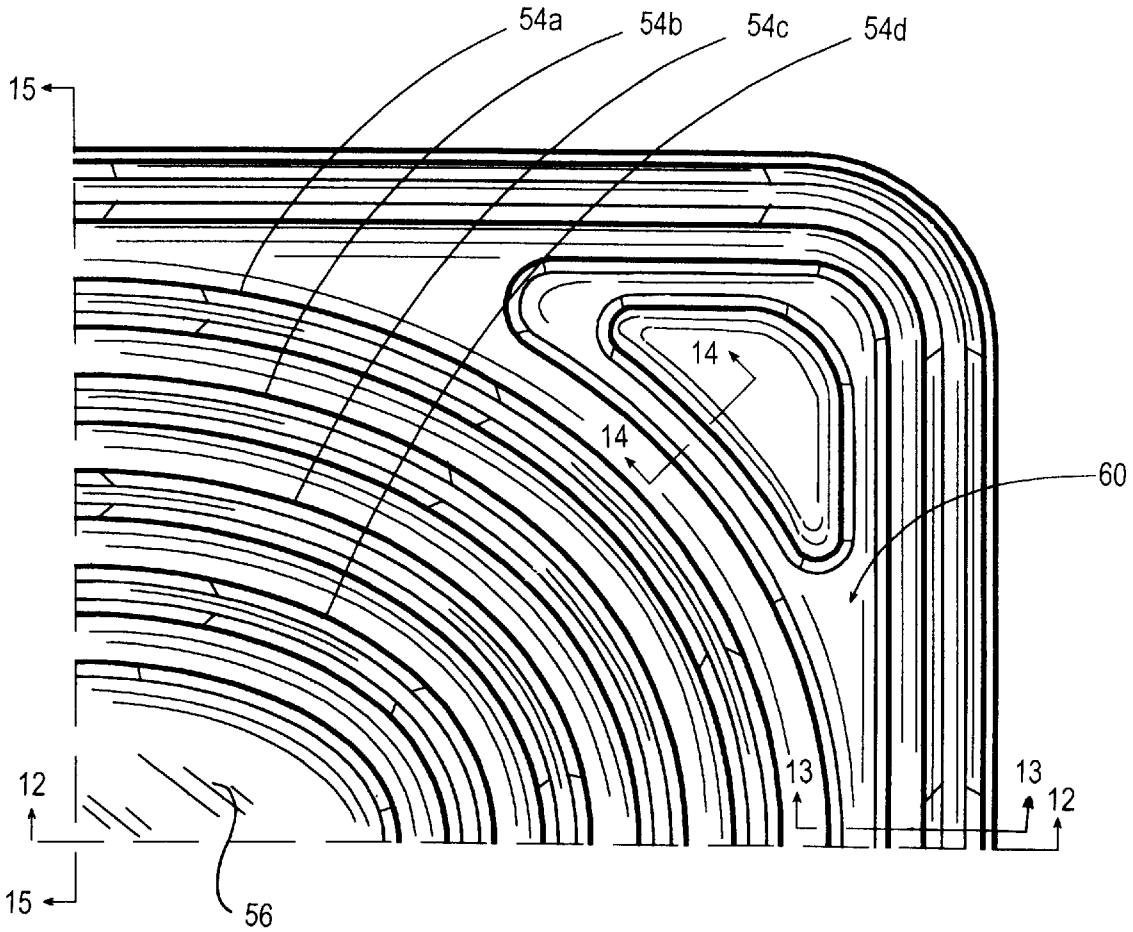
FIG. 11 is an enlarged top view of one-fourth of the bottom panel of the foil container of FIG. 9.
Figure 12:
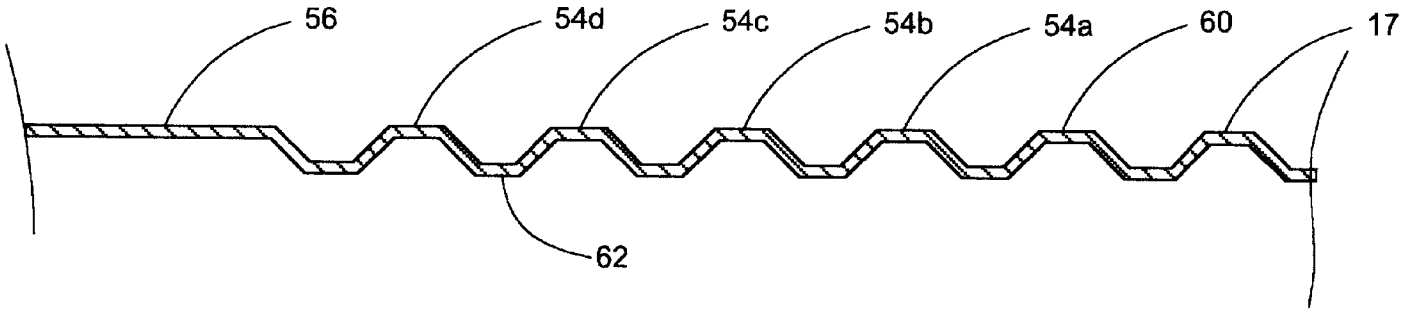
FIG. 12 is a section taken generally along line 12—12 in FIG. 11.
Figure 13:
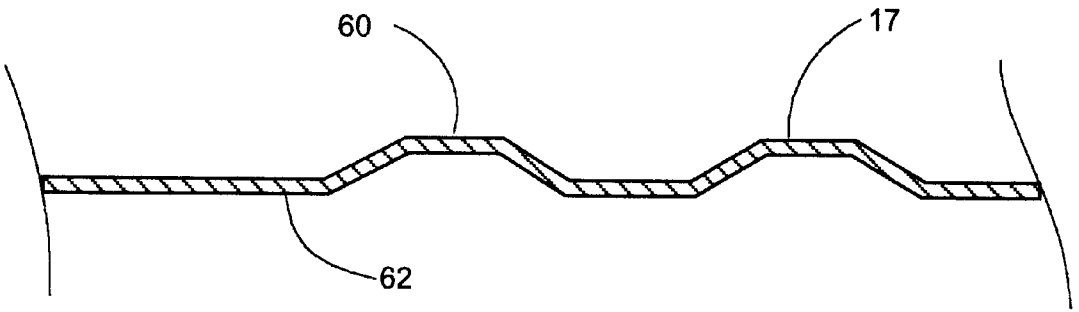
FIG. 13 is a section taken generally along line 13—13 in FIG. 11.
Figure 14:
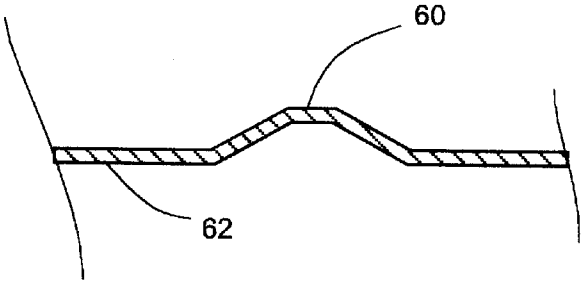
FIG. 14 is a section taken generally along line 14—14 in FIG. 11.
Figure 15:
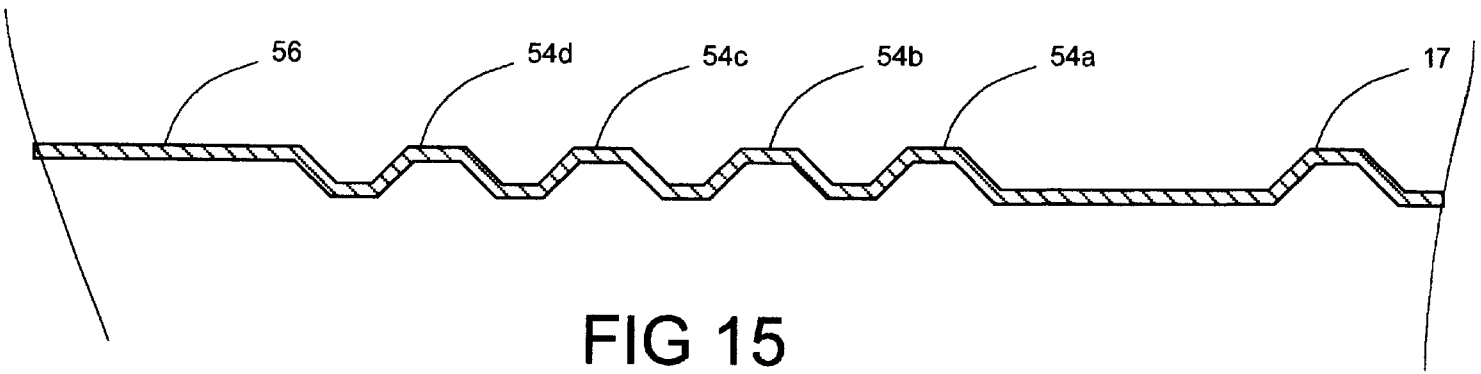
FIG. 15 is a section taken generally along line 15—15 in FIG. 11.

FIG. 11 is an enlarged top view of one-fourth of the bottom panel 52 of the foil container 50, and FIGS. 12–15 are sections taken along various line s in FIG. 11. The sections allow the cross-sectional shapes and relative heights of the elliptical ribs 54*a–d*, elliptical embossment 56, and lowermost surface 62 of the bottom panel 52 to be more readily visualized. In FIGS. 12 and 15, for example, it can be seen that the elliptical ribs 54*a–d* are generally trapezoidal in cross-section and that these ribs 54*a–d* and the elliptical embossment 56 extend to the same height above the lowermost surface 62. In FIGS. 12 and 13, it can be seen that the peripheral rib 17 and the outer rib structure 60 are generally trapezoidal in cross-section and that the rib 17 and the rib structure 60 extend to the same height above the lowermost surface 62. FIG. 12 shows that the elliptical ribs 54*a–d*, elliptical embossment 56, outer rib structure 60, and peripheral rib 17 extend to the same height above the lowermost surface 62 of the bottom panel 52.

When arranged as described above, the elliptical ribs 54*a–d* effectively disperse torsional and bending stresses applied to the container 50 and thereby optimize the bend resistance of the bottom panel 52. Referring to FIG. 10 , there is shown an example of how the elliptical ribs 54*a–d* react to a bending stress S initiated at the periphery of the bottom panel 52 along the transverse axis T. The initial bending stress S is represented by an arrow labeled S. If the bending stress S encounters the outermost elliptical rib 54*a*, the rib 54*a* effectively distributes some or all of the bending stress along the rib 54*a* as shown by the diverging arrows $S_1$ and $S_2$. The curvature of the rib 54*a* promotes the dispersion of the bending stress S. Any remaining bending stress that is not successfully dispersed by the rib 54*a* successively encounters one or more of the remaining elliptical ribs, each of which serves to partially or fully disperse the encountered bending stress.

Figure 16:
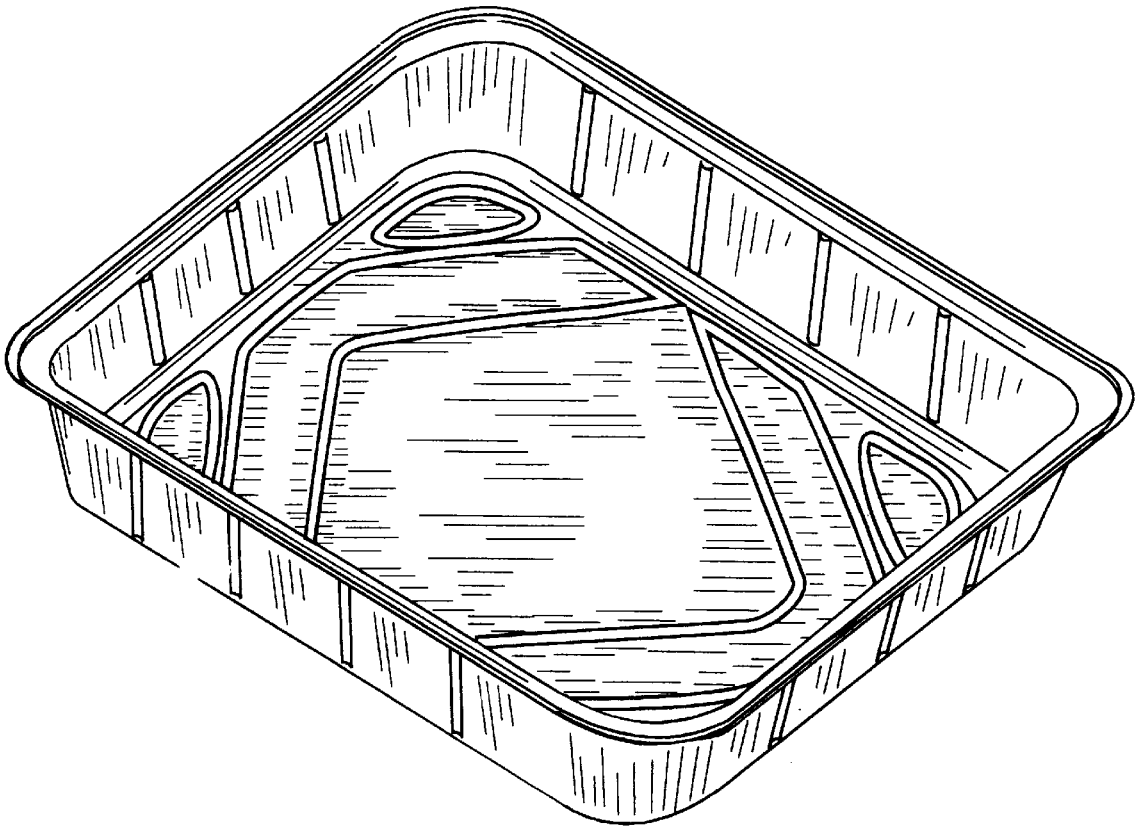
FIG 16 Prior Art
FIG. 16 is an isometric view of a prior art foil container.

It has been found that the bottom panel 12 in FIGS. 1 and 2 and the bottom panel 52 in FIGS. 9 and 10 significantly improve the bend strength of the respective foil containers 10 and 50 relative to prior art foil containers. An example of a prior art foil container is depicted in FIG. 16. To illustrate the improvement in bend strength caused by the strength-enhancing bottom panels 12 and 52, a bend strength test was conducted comparing the bend strength of the prior art container in FIG. 16 with modified versions of the foil containers 10 (FIGS. 1 and 2) and 50 (FIGS. 9 and 10). The foil containers 10 and 50 were modified for the bend strength test to include the same continuous wall panel and continuous rim as the prior art container in FIG. 16 so that the only difference between the modified containers and the prior art container was the bottom panel. With the bottom panel being the only difference between the containers, an differences in the test results are directly attributable to the different bottom panels.

To measure the bend strength of a tested container, the container was clamped along its two shorter sides (end walls) by respective clamps, held away from a support surface, and slowly filled with lead shot. When first and second deflection points occurred, the respective weights of the lead shot within the container were recorded. The first deflection point corresponded to the formation of one buckle on one of the four sides of the container. The second deflection point corresponded to the formation of another buckle on one of the remaining three sides of the container.

Two sets of bend strength tests were conducted. The first bend strength test compared the bend strength of the prior art container in FIG. 16 with the modified versions of the foil containers 10 (FIGS. 1 and 2) and 50 (FIGS. 9 and 10), where all the containers were composed of hardened aluminum having a hardness rating of H23 on the ASTM scale. Ten samples of each container were tested. The results of this test are given below:

Prior Art Foil Container in FIG. 16
Composed 0f H23 Aluminum

| Sample No. | 1st Deflection (lbs.) | 2nd Deflection (lbs.) | Gauge (inches) |
|---|---|---|---|
| 1 | 14.60 | 25.00 | 0.00433 |
| 2 | 15.00 | 18.40 | 0.00432 |
| 3 | 12.20 | 22.40 | 0.00428 |
| 4 | 13.80 | 18.30 | 0.00433 |
| 5 | 13.60 | 20.70 | 0.00439 |
| 6 | 13.70 | 19.00 | 0.00437 |
| 7 | 13.10 | 20.50 | 0.00438 |
| 8 | 13.60 | 25.00 | 0.00438 |
| 9 | 13.20 | 22.00 | 0.00435 |
| 10 | 13.20 | 20.00 | 0.00438 |
| Average | 13.60 | 21.13 | 0.00435 |
| Standard Deviaton | 0.74 | 2.33 | 0.00003 |
| Maximum | 15.00 | 25.00 | 0.00439 |
| Minimum | 12.20 | 18.30 | 0.00428 |
| Range | 2.80 | 6.70 | 0.00011 |

Modified Version of Foil Container 10 in FIGS. 1 and 2
Composed of H23 Aluminum

| Sample No. | 1st Deflection (lbs.) | 2nd Deflection (lbs.) | Gauge (inches) |
|---|---|---|---|
| 1 | 25.00 | | 0.00426 |
| 2 | 24.20 | | 0.00438 |
| 3 | 30.00 | | 0.00429 |
| 4 | 30.00 | | 0.00433 |
| 5 | 23.00 | | 0.00431 |
| 6 | 30.00 | | 0.00430 |
| 7 | 30.00 | | 0.00433 |
| 8 | 26.00 | | 0.00431 |
| 9 | 26.50 | | 0.00438 |
| 10 | 30.00 | | 0.00432 |
| Average | 27.47 | | 0.00432 |
| Standard Deviation | 2.68 | | 0.00004 |
| Maximum | 30.00 | | 0.00438 |
| Minimum | 23.00 | | 0.00426 |
| Range | 7.00 | | 0.00012 |

Modified Version of Foil Container 50 in FIGS. 9 and 10
Composed of H23 Aluininum

| Sample No. | 1st Deflection (lbs.) | 2nd Deflection (lbs.) | Gauge (inches) |
|---|---|---|---|
| 1 | 18.50 | 22.50 | 0.00445 |
| 2 | 17.00 | 21.00 | 0.00435 |
| 3 | 17.60 | 19.80 | 0.00440 |
| 4 | 16.80 | 19.00 | 0.00438 |
| 5 | 17.20 | 20.00 | 0.00445 |
| 6 | 16.70 | 21.80 | 0.00441 |
| 7 | 15.30 | 19.10 | 0.00440 |
| 8 | 17.80 | 20.70 | 0.00436 |
| 9 | 17.40 | 21.00 | 0.00441 |
| 10 | 16.80 | 21.60 | 0.00445 |
| Average | 17.11 | 20.65 | 0.00441 |
| Standard Deviation | 0.80 | 1.10 | 0.00003 |
| Maximum | 18.50 | 22.50 | 0.00445 |
| Minimum | 15.30 | 19.00 | 0.00435 |
| Range | 3.20 | 3.50 | 0.00010 |

The second bend strength test compared the bend strength of the prior art container in FIG. 16 with the modified versions of the foil containers 10 (FIGS. 1 and 2) and 50 (FIGS. 9 and 10), where all the containers were composed of dead soft aluminum. Ten samples of each container were tested. The results of this test are given below:

Prior Art Foil Container in FIG. 16
Composed of Dead Soft Aluminum

| Sample No. | 1st Deflection (lbs.) | 2nd Deflection (lbs.) | Gauge (inches) |
|---|---|---|---|
| 1 | 7.30 | 8.70 | 0.00425 |
| 2 | 7.70 | 9.40 | 0.00426 |
| 3 | 8.20 | 10.00 | 0.00427 |
| 4 | 7.50 | 8.80 | 0.00426 |
| 5 | 7.60 | 9.40 | 0.00428 |
| 6 | 8.00 | 9.50 | 0.00423 |
| 7 | 8.10 | 10.00 | 0.00428 |
| 8 | 7.90 | 9.50 | 0.00424 |
| 9 | 7.10 | 8.60 | 0.00427 |
| 10 | 7.60 | 9.10 | 0.00426 |
| Average | 7.70 | 9.30 | 0.00426 |
| Standard Deviation | 0.33 | 0.47 | 0.00002 |
| Maximum | 8.20 | 10.00 | 0.00428 |
| Minimum | 7.10 | 8.60 | 0.00423 |
| Range | 1.10 | 1.40 | 0.00005 |

Modified Version of Foil Container 10 in FIGS. 1 and 2
Composed of Dead Soft Aluminum

| Sample No. | 1st Deflection (lbs.) | 2nd Deflection (lbs.) | Gauge (inches) |
|---|---|---|---|
| 1 | 11.20 | | 0.00431 |
| 2 | 10.70 | 11.50 | 0.00430 |
| 3 | 10.70 | | 0.00430 |
| 4 | 10.80 | 12.10 | 0.00435 |
| 5 | 10.50 | 11.00 | 0.00429 |
| 6 | 10.70 | 11.70 | 0.00429 |
| 7 | 10.50 | 11.40 | 0.00427 |
| 8 | 11.40 | | 0.00433 |
| 9 | 10.40 | 11.40 | 0.00431 |
| 10 | 10.00 | 10.70 | 0.00430 |
| Average | 10.69 | 11.40 | 0.00431 |
| Standard Deviation | 0.38 | 0.42 | 0.00002 |

-continued

Modified Version of Foil Container 10 in FIGS. 1 and 2
Composed of Dead Soft Aluminum

| Sample No. | 1st Deflection (lbs.) | 2nd Deflection (lbs.) | Gauge (inches) |
|---|---|---|---|
| Maximum | 11.40 | 12.10 | 0.00435 |
| Minimum | 10.00 | 10.70 | 0.00427 |
| Range | 1.40 | 1.40 | 0.00008 |

Modified Version of Foil Container 50 in FIGS. 9 and 10
Composed of Dead Soft Aluminum

| Sample No. | 1st Deflection (lbs.) | 2nd Deflection (lbs.) | Gauge (inches) |
|---|---|---|---|
| 1 | 11.70 | 13.80 | 0.00431 |
| 2 | 12.30 | 13.10 | 0.00429 |
| 3 | 11.50 | 12.50 | 0.00424 |
| 4 | 11.20 | 12.30 | 0.00431 |
| 5 | 11.50 | 12.30 | 0.00432 |
| 6 | 11.40 | 13.00 | 0.00427 |
| 7 | 11.20 | 12.50 | 0.00431 |
| 8 | 10.60 | 12.80 | 0.00430 |
| 9 | 11.30 | 12.80 | 0.00432 |
| 10 | 11.20 | 12.50 | 0.00434 |
| Average | 11.39 | 12.76 | 0.00430 |
| Standard Deviation | 0.41 | 0.43 | 0.00003 |
| Maximum | 12.30 | 13.80 | 0.00434 |
| Minimum | 10.60 | 12.30 | 0.00424 |
| Range | 1.70 | 1.50 | 0.00010 |

It can be seen that the modified versions of the foil containers 10 and 50 embodying the present invention generally exhibited greater bend strength than the prior art container in FIG. 16. With respect to the containers composed of H23 aluminum, the first deflection points of the modified foil containers 10 and 50 occurred at higher weights than the first deflection point of the prior art container. The second deflection point of the modified foil container 50 occurred at approximately the same weight as the second deflection point of the prior art container. The modified foil container 10 did not have a second deflection point; rather, either the first deflection point was exacerbated or the entire bottom panel 12 bulged without the formation of a second deflection point.

With respect to the containers composed of dead soft aluminum, the first deflection points of the modified foil containers 10 and 50 occurred at higher weights than the first deflection point of the prior art container. Similarly, the second deflection points, if they existed, of the modified containers 10 and 50 occurred at higher weights than the second deflection point of the prior art container. The modified container 10 occasionally did not have a second deflection point because two buckles were simultaneously formed at opposite ends of the container 10. In effect, the first deflection point also served as a second deflection point when no second deflection point was recorded.

While the present invention has been described with reference to one or more is particular embodiments, those skilled in the art will recognize that many changes may be made thereto without departing from the spirit and scope of the present invention. For example, a skeletal handle assembly may be fixedly secured to the foil container 10 in order to further reinforce the container 10. One such handle assembly is described and illustrated in U.S. Pat. No.

5,029,721 to Timpe, which is incorporated herein by reference. Each of these embodiments and obvious variations thereof is contemplated as falling within the spirit and scope of the claimed invention, which is set forth in the following claims.

What is claimed is:

1. A foil container formed from a single sheet of metal about orthogonal longitudinal and transverse axes, comprising:

a generally rectangular bottom panel having a peripbery;

a continuous wall panel encompassing said bottom panel and extending upwardly and outwardly from said bottom panel, said continuous wall panel forming a pair of opposing side walls and a pair of opposing end walls, said end walls bridging said side walls, said side walls being at least as long as said end walls; and a continuous rim encompassing an upper edge of said continuous wall panel and projecting laterally outwardly therefrom;

said bottom panel forming a plurality of closely spaced, concentric non-circular elliptical ribs, said elliptical ribs occupying a substantial portion of said bottom panel, said elliptical ribs having respective centers coinciding with a center of said bottom panel, an outermost one of said elliptical ribs being located in close proximity to said pair of opposing side walls, an innermost one of said elliptical ribs being located in close proximity to the center of said bottom panel, said bottom panel also forming a pair of outer rib structures generally occupying corners of said bottom panel and located outside said outermost one of said elliptical ribs, each of said outer ribs structures including a curved portion and a straight portion defining closed loops at respective ends of said bottom panel, said curved portion having approximately the same curvature as said elliptical ribs and being concave with respect to the center of said bottom panel, said straight portion conforming to a portion of said periphety of said generally rectangular bottom panel.

2. The container of claim 1, wherein said elliptical ribs are equally spaced from each other.

3. The container of claim 1, wherein said bottom panel forms a central elliptical embossment encompassed by said innermost one of said elliptical ribs.

4. The container of claim 3, wherein said elliptical ribs and said elliptical embossment extend for approximately a same height above a lowermost surface of said bottom panel.

5. The container of claim 1, wherein said bottom panel forms a generally rectangular peripheral rib disposed adjacent to a lowermost edge of said continuous wall panel and encompassing said elliptical ribs.

6. A foil container formed from a single sheet of metal about orthogonal longitudinal and transverse axes, comprising:

a generally rectangular bottom panel having a periphery;

a continuous wall panel encompassing said bottom panel and extending upwardly and outwardly from said bottom panel, said continuous wall panel forming a pair of opposing side walls and a pair of opposing end walls, said end walls bridging said side walls, said side walls being at least as long as said end walls; and a continuous rim encompassing an upper edge of said continuous wall panel and projecting laterally outwardly therefrom;

said bottom panel forming a plurality of uninterrupted, closely spaced, concentric non-circular elliptical ribs, an outermost one of said elliptical ribs being located in close proximity to said pair of opposing side walls and said pair of opposing end walls, an innermost one of said elliptical ribs being located in close proximity to the center of said bottom panel, said bottom panel also forming a pair of outer rib structures generally occupying comers of said bottom panel and located outside said outermost one of said elliptical ribs, each of said outer ribs structures including a curved portion and a straight portion defining closed loops at respective ends of said bottom panel, said curved portion having approximately the same curvature as said elliptical ribs and being concave with respect to the center of said bottom panel, said straight portion conforming to a portion of said periphery of said generally rectangular bottom panel.

7. The container of claim 6, wherein said bottom panel forms a generally rectangular peripheral rib disposed adjacent to a lowermost edge of said continuous wall panel and encompassing said elliptical ribs.

* * * * *

UNITED STATES PATENT AND TRADEMARK OFFICE

CERTIFICATE OF CORRECTION

PATENT NO. : 6,149,053

DATED : November 21, 2000

INVENTOR(S) : Chadd R. Chatterton et al

It is certified that error appears in the above-identified patent and that said Letters Patent is hereby corrected as shown below:

In claim 1, col. 11, line 39, please replace "periphety" with --periphery--.

Signed and Sealed this

First Day of May, 2001

*Attest:*

Nicholas P. Godici

NICHOLAS P. GODICI

*Attesting Officer*

*Acting Director of the United States Patent and Trademark Office*